US008068772B2

(12) United States Patent
Sato

(10) Patent No.: US 8,068,772 B2
(45) Date of Patent: Nov. 29, 2011

(54) DEVELOPMENT DEVICE AND IMAGE FORMING APPARATUS

(75) Inventor: Toshiharu Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 363 days.

(21) Appl. No.: 12/236,931

(22) Filed: Sep. 24, 2008

(65) Prior Publication Data

US 2009/0092421 A1 Apr. 9, 2009

(30) Foreign Application Priority Data

Sep. 25, 2007 (JP) ..... 2007-248075

(51) Int. Cl.
*G03G 15/08* (2006.01)

(52) U.S. Cl. ..... 399/286; 399/279

(58) Field of Classification Search ..... 399/286, 399/279
See application file for complete search history.

(56) References Cited

U.S. PATENT DOCUMENTS

| | | | | |
|---|---|---|---|---|
| 7,078,143 | B2 * | 7/2006 | Hashimoto et al. | 430/131 |
| 2005/0226659 | A1 * | 10/2005 | Ebe | 399/286 |
| 2006/0198664 | A1 * | 9/2006 | Ebe | 399/286 |

FOREIGN PATENT DOCUMENTS

| | | | |
|---|---|---|---|
| JP | 07-319287 | A | 12/1995 |
| JP | 2004341511 | A * | 12/2004 |
| JP | 2006-243358 | A | 9/2006 |

* cited by examiner

*Primary Examiner* — David Gray
*Assistant Examiner* — David Bolduc
(74) *Attorney, Agent, or Firm* — Panitch Schwarze Belisario & Nadel LLP

(57) ABSTRACT

A development device includes a developer carrier supplying developer to an electrostatic latent image carrier which is rotatable. The developer carrier includes a conductive metal core and a conductive elastic layer that is disposed outside a circumference of the conductive metal core and includes a surface having a roughness formed thereon. The surface of the conductive elastic layer satisfies a relationship $1.0<Rz2/Rz1<1.60$, where Rz1 and Rz2 are ten-point mean roughenesses in a circumference direction and an axial direction of the developer carrier, respectively, and satisfies a relationship $0.20<Sm2/Sm1<1.00$, where Sm1 and Sm2 are mean widths of profile elements of the surface of the conductive elastic layer in the circumference direction and the axial direction of the developer carrier, respectively.

6 Claims, 8 Drawing Sheets

Rz2/Rz1=1.55
Sm2/Sm1=0.42

Rz2/Rz1=1.55
Sm2/Sm1=0.42

Rz2/Rz1=1.05
Sm2/Sm1=1.05

Rz2/Rz1=0.91
Sm2/Sm1=1.30

DEVELOPMENT DEVICE AND IMAGE FORMING APPARATUS

BACKGROUND OF THE INVENTION

1. Field of the Invention

The present invention relates to a development device installed in a printer or a photocopier employing an electrophotographic method, and relates to an image forming apparatus including the development device.

2. Description of Related Art

A development device of an image forming apparatus such as an electrophotographic printer, a photocopier, a facsimile and a multifunctional device includes a developer carrier carrying a developer thereon and develops an electrostatic latent image formed on an electrostatic latent image carrier with the developer carried on the developer carrier. Here, a surface of the developer carrier is made rough such that an image to be formed on a recording medium has an adequate density. For example, roughness of the developer carrier in a circumferential direction and a mean width of profile elements are defined to obtain the adequate density (See, e.g., Japanese Un-examined Patent Application Publication No. H07-319287).

The image to be formed on the recording medium, however, may not have the adequate density although the roughness of the developer carrier in the circumferential direction and the mean width of profile elements are defined.

BRIEF SUMMARY OF THE INVENTION

According to one aspect of the invention, a development device includes a developer carrier supplying developer to an electrostatic latent image carrier being rotatable, the developer carrier includes: a conductive metal core; and a conductive elastic layer, disposed outside circumference of the conductive metal core, including a surface having roughness formed thereon, and the surface of the conductive elastic layer satisfies a relationship $1.0 \leqq Rz2/Rz1 \leqq 1.60$, where Rz1 is ten-point mean roughness in a circumference direction and Rz2 is ten-point mean roughness in an axial direction of the developer carrier, and a relationship $0.20 \leqq Sm2/Sm1 \leqq 1.00$, where Sm1 is a mean width of profile elements of the surface of the conductive elastic layer in the circumference direction of the developer carrier, and Sm2 is a mean width of profile elements of the surface of the conductive elastic layer in the axial direction of the developer carrier.

According to another aspect of the present invention, an image forming apparatus includes: the development device described above; an exposure device exposing a surface of the electrostatic latent image carrier to form an electrostatic latent image based on image information; a transfer unit transferring an developer image formed by development of the electrostatic latent image formed on the surface of the electrostatic latent image carrier by the exposure device with the developer carrier to a recording sheet; and a fixing unit fixing the developer image transferred by the transfer unit to the recording sheet.

Additional features and advantages of the present invention will be more fully apparent from the following detailed description of embodiments, the accompanying drawings and the associated claims.

BRIEF DESCRIPTION OF THE DRAWINGS

A more complete appreciation of the aspects of the invention and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
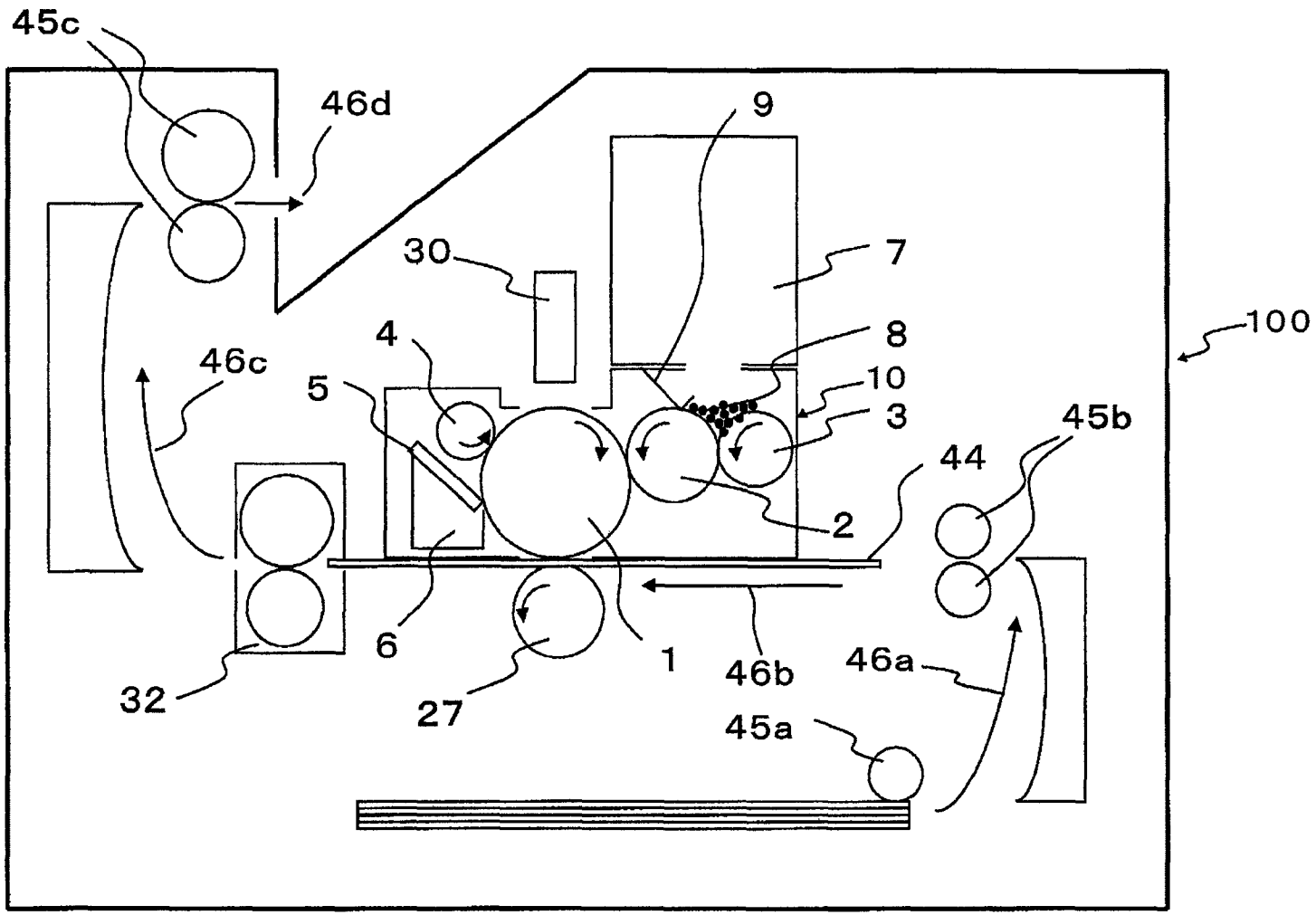
FIG. 1 is a schematic diagram illustrating a development device and an image forming apparatus according to an embodiment of the present invention.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

In the following detailed description, reference is made to the accompanying drawings, wherein like reference numerals designate identical or corresponding parts throughout the several views. A description of the present invention is now given below with regard to a particular embodiment, but the present invention is not limited thereto and it must be understood that the invention encompasses all modifications possible not departing from the scope of the invention.

An image forming apparatus 100 according to an embodiment of the present invention includes a development device 10 having a development roller 2 serving as a developer carrier. A description of the image forming apparatus 100 of the present invention is given with reference to FIG. 1 that illustrates the image forming apparatus 100 and development device 10 in a schematic diagram, and with reference to FIG. 2 that illustrates control of the image forming apparatus 100 in a block diagram.

As illustrated in FIG. 1, the image forming apparatus 100 includes the development device 10 therein. A toner cartridge 7 containing toner 8 serving as developer therein is detachably disposed to the development device 10, and the development device 10 includes a photosensitive drum 1 serving as an electrostatic latent image carrier and a development roller 2 serving as a developer carrier disposed opposite to the photosensitive drum 1. For example, the photosensitive drum 1 has an outside diameter of 30 mm and rotates at a circumferential speed of 103.13 rpm. A circumferential speed (described later) of the development roller 2 is arranged in such a manner to be, for example, 1.239 where the circumferential speed of the photosensitive drum 1 is arranged to be 1. The development device 10 also includes a supply roller 3 serving as a developer supplying member supplying the toner 8 to the development roller 2, a charging roller 4 charging the photosensitive drum 1, a development blade 9 serving as a toner layer pressure adjustment blade laminating the toner 8 supplied on the development roller 2, a cleaning blade 5 scraping transfer residual toner on the photosensitive drum 1, and a toner collection box 6 colleting the transfer residual toner scraped by the cleaning blade 5.

In addition to the development device 10, the image forming apparatus 100 includes conveyance rollers 45*a*, 45*b* and 45*c* controlled by a sheet conveyance motor 34 to convey a sheet 44 serving as a recording medium, a light emitting diode (LED) head 30 serving as an exposure device exposing a surface of the photosensitive drum 1 of the development device 10 to form the electrostatic latent image thereon, a transfer roller 27 serving as a transfer member transferring a toner image developed on the photosensitive drum 1 by the development device 10 onto the sheet 44, and a fixing device 32 having a heater (not shown) melting the toner 8 of the toner image transferred onto the sheet 44 by the transfer roller 27 and a temperature sensor (not shown) reading a temperature of the fixing device 32 heated by the heater.

Figure 2:
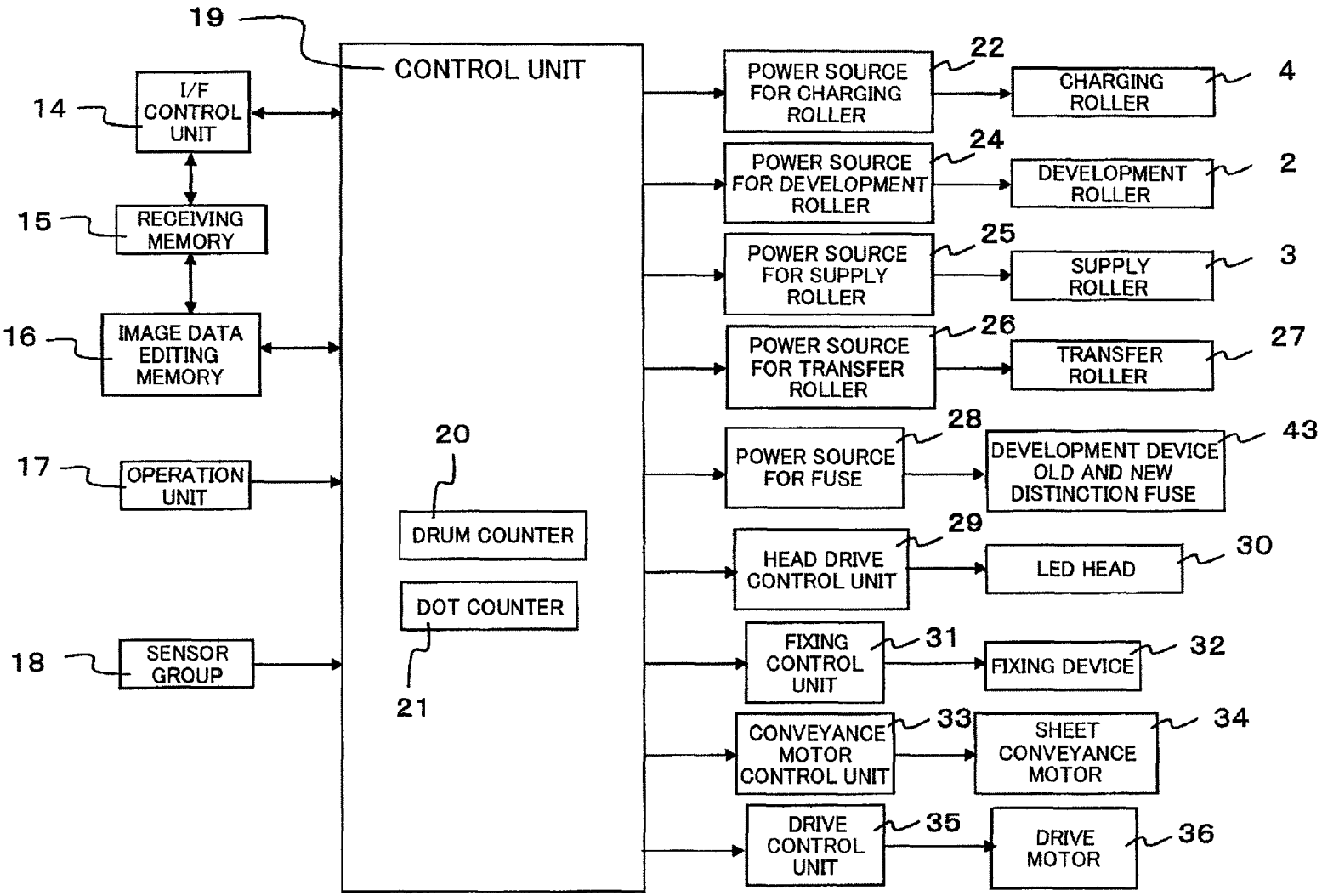
FIG. 2 is a block diagram illustrating the image forming apparatus according to the embodiment of the invention.

As illustrated in FIG. 2, the image forming apparatus 100 includes a control unit 19, a drum counter 20, a dot counter 21, an interface (I/F) control unit 14, a receiving memory 15, an image data editing memory 16, an operation unit 17, a sensor group 18, a power source 22 for the charging roller 4, a power source 24 for the development roller 2, a power source 25 for the supply roller 3, a power source 26 for the transfer roller 27, a power source 28 for a fuse, a head drive control unit 29, a fixing control unit 31, a conveyance motor control unit 33, and a drive control unit 35.

The control unit 19 includes a microprocessor, a read only memory (ROM), a random access memory (RAM), an input port and a timer, and controls the drum counter 20 counting a number of rotations of the photosensitive drum 1 or the dot counter 21 counting print dots. The control unit 19 receives print data or a control command from a higher-level device (not shown) through the I/F control unit 14, controls image formation as a whole, and executes a print operation.

The receiving memory 15 temporarily records the print data or the control command received through the I/F control unit 14. The image data editing memory 16 receives the print data recorded in the receiving memory 15 and records image data formed by editing the print data.

The operation unit 17 includes an LED displaying a state of the image forming apparatus 100 and a switch or a display unit providing an instruction from an operator to the image forming apparatus 100. The sensor group 18 includes a plurality of sensors (not shown), for example, a sheet position detection sensor, a temperature-humidity sensor and a density sensor, each of which is disposed to monitor an operation state of the image forming apparatus 100.

The power source 22 for the charging roller 4 applies a predetermined voltage to the charging roller 4. The power source 24 for the development roller 2 applies a predetermined voltage to the development roller 2. The power source 25 for the supply roller 3 applies a predetermined voltage to the supply roller 3. The power source 26 for the transfer roller 27 applies a predetermined voltage to the transfer roller 27. The power sources 22, 24 and 25 can change the voltage to be applied to the charging roller 4, the development roller 2 and the supply roller 3 respectively in accordance with instructions of the control unit 19.

The power source 28 for the fuse applies a current to a development device old and new distinction fuse 43 that determines whether or not the development device 10 is not used ever. The head drive control unit 29 controls drive of the LED head 30 and transmits the image data stored in the image data editing memory 16 to the LED head 30. The fixing control unit 31 reads an output from an temperature sensor (not shown) of the fixing device 32, and controls a temperature of the fixing device 32 to be a constant level by energizing the heater (not shown) based on the sensor output from the temperature sensor (not shown). The conveyance motor control unit 33 controls the sheet conveyance motor 34 and drives or halts the conveyance rollers 45*a*, 45*b* and 45*c*, so that the sheet 44 is conveyed to directions 46*a*, 46*b*, 46*c* and 46*d* indicated by respective arrows shown in FIG. 1. The drive control unit 35 controls a drive motor 36 that rotates the photosensitive drum 1. The charging roller 4, the development roller 2 and the supply roller 3 rotate in directions indicated by respective arrows shown in FIG. 1 with a rotation of the photosensitive drum 1 in a direction indicated by an arrow shown in FIG. 1.

The image forming apparatus 100 stores the print data received by the I/F control unit 14 in the receiving memory 15, and the control unit 19 controls a sequence of the image forming apparatus 100 as a whole so as to execute the print operation. After the print data are received, the control unit 19 controls the conveyance motor control unit 33 to drive the conveyance roller 45*a* by the sheet conveyance motor 34, so that the sheet 44 is rolled at a predetermined timing and is conveyed to the direction indicated by the arrow 46*a* shown in FIG. 1. The sheet 44 is further conveyed to the development device 10 by the conveyance rollers 45*b* driven by the sheet conveyance motor 34. The sheet 44 passed the conveyance rollers 45*b* is conveyed between the development device 10 and the transfer roller 27 toward the direction indicated by the arrow 46*b* at a timing at which the toner image formed by the development device 10 is transferred.

Here, the development device 10 forms the toner image. In an image forming process, control data are transmitted from the control unit 19 to the drive control unit 35. Upon receiving the control data, the drive control unit 35 controls the drive motor 36 to rotate the photosensitive drum 1. The power source 22 for the charging roller 4 applies negative voltage to the charging roller 4 rotating with rotation of the photosensitive drum 1, so that the surface of the photosensitive drum 1 is charged.

On the other hand, the print data stored in the receiving memory 15 is converted by the image data editing memory 16. The converted image data are transmitted to the head drive control unit 29 through the control unit 19. The head drive control unit 29 controls the LED head 30 based on the received image data, so that the LED head 30 exposes the surface of the photosensitive drum 1. Therefore, the electrostatic latent image corresponding to the image data are formed on the charged surface of the photosensitive drum 1.

The development roller 2 and the supply roller 3 rotating with rotation of the photosensitive drum 1 are applied with the voltage instructed from the control unit 19, and the toner 8 contained in the toner cartridge 7 is supplied to the development roller 2 through the supply roller 3. The toner 8 supplied to the development roller 2 passes through the development blade 9, so that a thin layer is formed on the development roller 2. The electrostatic latent image formed on the surface of the photosensitive drum 1 is developed by the thin layer of the toner 8 on the development roller 2, and the toner image is formed on the photosensitive drum 1.

Before the sheet 44 passes between the development roller 10 and the transfer roller 27, the transfer roller 27 is applied with the predetermined voltage from the power source 26 for transfer roller 27. Therefore, the toner image is transferred onto the sheet 44 passing between the photosensitive drum 1 and the transfer roller 27 with physical pressure and electrostatic force in a pressure area in which the photosensitive drum 1 and the transfer roller 27 press against each other.

The sheet 44 having the toner image transferred thereon passes through the fixing device 32 controlled by the fixing control unit 31, thereby attaching the toner with heat and pressure and fixing the toner image on the sheet 44. After the toner image is fixed, the sheet 44 is conveyed toward the direction indicated by the arrow 46*c* shown in FIG. 1 and is conveyed by the conveyance rollers 45*c* to the direction indicated by the arrow 46*d*, that is, the outside the image forming apparatus 100.

Although the image forming apparatus 100 of the present invention described above includes the development device 10, the present invention is not limited thereto. For example, the image forming apparatus 100 may include four development devices that correspond to respective four colors of the toner such as cyan, magenta, yellow, and black and are disposed parallel along a transfer belt from a sheet-feeding side to a sheet ejection side. In such a case, each of the development devices 10 transfers the toner image of respective color at a timing of the sheet 44 being conveyed based on the control of control unit 19, thereby forming a multi-color image.

Figure 3:
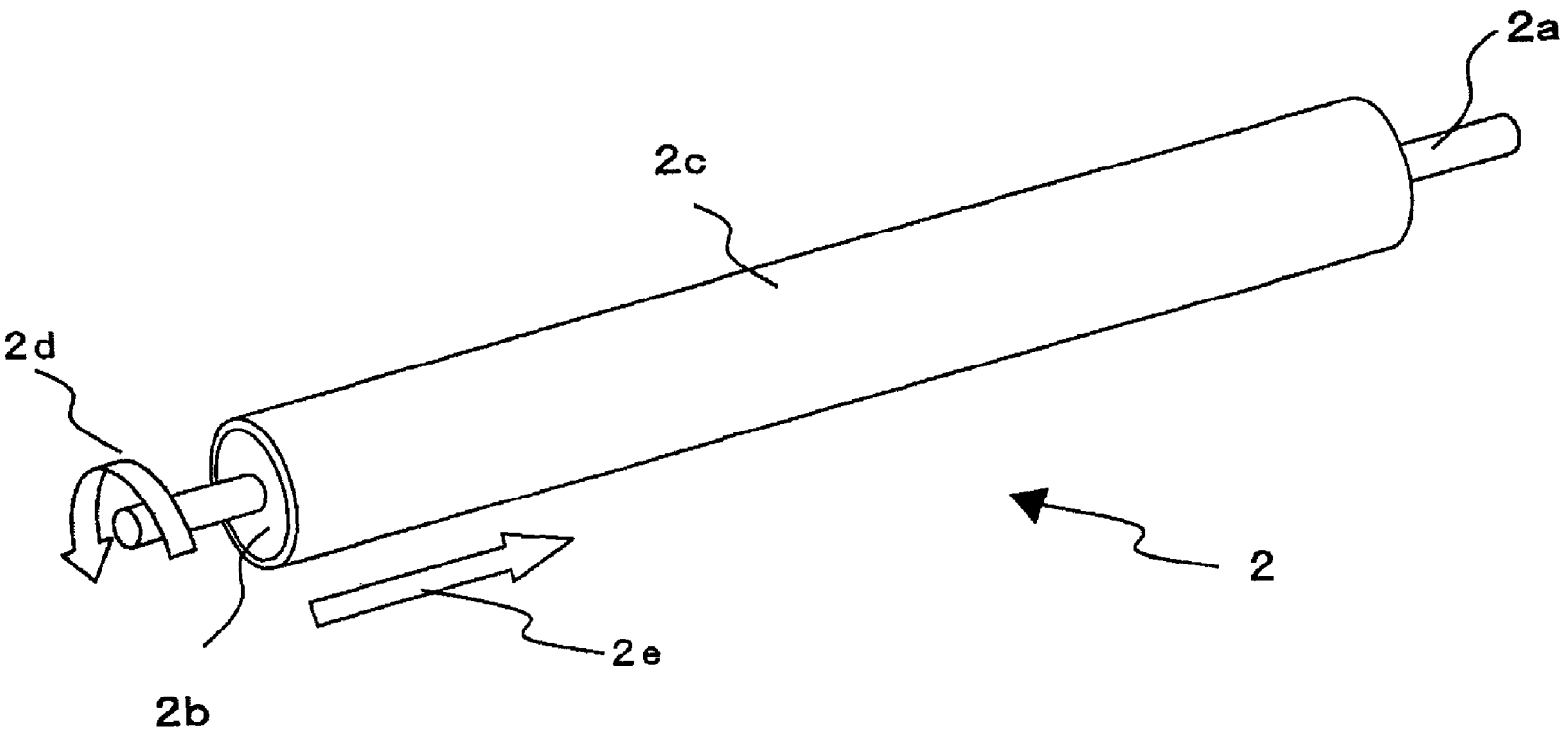
FIG. 3 is a schematic diagram illustrating a development roller disposed in the development device according to the embodiment of the present invention.

Referring to FIG. 3, the development roller 2 disposed in the development device 10 is illustrated. The development roller 2 includes a metal core 2*a* having electric conductivity and an elastic layer 2*b* having electric conductivity adhered to an outer circumference of the metal core 2*a* though a primer. The development roller 2 rotates in a circumferential direction of the development roller 2 (i.e., a direction indicated by an arrow 2*d* shown in FIG. 3) in the image forming process described above. The metal core 2*a* can be a metal having predetermined rigidity and adequate electric conductivity, and may be made of, for example, a metal that a free cutting sulfur steel (also referred to as SUM) is plated with electroless nickel.

A length of the elastic layer 2*b* in a longitudinal direction of the development roller 2 (i.e., a direction indicated by an arrow 2*e* shown in FIG. 3) satisfies a length of an image print region, and the elastic layer 2*b* is preferably a resistance layer providing a volume resistivity of $10^5$ to $10^{11}$ (Ω·cm) and employs a material that is easily deformable and recoverable of JIS-A hardness 20 to 60 degrees ("JIS" stands for Japanese Industrial Standards). The electric conductivity of the elastic layer 2*b* can be provided by adding an electric conductive agent thereto. The elastic layer 2*b* can be made of rubber or elastomer, etc., having thermoplasticity, etc. For example, a rubber composition having one material or mixing more than two materials such as chloroprene rubber, epichlorohydrin rubber, ethylene propylene rubber, urethane rubber, silicone rubber, and nitrile rubber as a principal component can be used.

The development roller 2 includes a surface layer 2*c* serving as an outside surface of the elastic layer 2*b*, and roughness is formed on the surface layer 2*c*. The roughness to be formed on the surface layer 2*c* can be provided by a method for forming thereof by molding in a state that particles are mixed with resin material liquid used in the course of forming the elastic layer 2*b* having the electric conductivity, a method for forming thereof by application of embossment to the surface of the elastic layer 2*b*, or a method for forming thereof by application of cutting work to the surface of the elastic layer 2*b*.

After the roughness is formed, a surface treatment and surface coating may be provided to the surface layer 2*c* as long as the surface of the surface layer 2*c* has predetermined polishing marks and surface roughness. For example, isocyanate or polyol and amino silane, etc. may be impregnated to or coated on the surface of the surface layer 2*c*. Moreover, the surface of the surface layer 2*c* may be coated by polyester resin, urethane resin, acrylic urethane resin, epoxy resin, nylon resin, fluorine resin and silicone resin, etc. In addition, the surface layer 2*c* may provide and prepare the electric conductivity thereof by adding the electric conductive agent such as carbon black to a surface treatment agent and a coating agent.

As described above, the development device 10 according to the embodiment of the present invention includes the development roller 2 having the surface layer 2*c* with the roughness.

Now, the development roller 2 according to the embodiment of the present invention capable of providing the adequate image density is examined by a relationship between ten-point mean roughness in the circumference direction (i.e., the direction indicated by the arrow 2*d* shown in FIG. 3) and ten-point mean roughness in an axial direction (i.e., the direction indicated by the arrow 2*e* shown in FIG. 3) of the development roller 2, and a relationship between a mean width of profile elements of the circumference direction (i.e., the arrow 2*d*) and a mean width of profile elements in the axial direction (i.e., the arrow 2*e*).

FIRST EXAMPLE EXPERIMENT

A description of measurement of the surface roughness indicating the roughness on the surface layer 2 of the development roller 2 is given below. The surface roughness was measured using a surface roughness analyzing system SE3500, a detection device PU-DJ2S, a circumference roughness measuring apparatus ZRM200 (each of which is available from Kosaka Laboratory Ltd, Japan) and an axial direction measuring jig. The surface roughness was measured by two measuring methods depending on a direction to be measured. The first measuring method was a measurement of the surface roughness in the circumference direction by contacting a vertex of the surface layer 2*c* with a contact pin of the detection device while the development roller 2 was being rotated in the circumference direction indicated by the arrow 2*d* shown in FIG. 3. The second measuring method was a measurement of the surface roughness in the axial direction by moving the contact pin of the detection device in a longitudinal direction indicated by the arrow 2*e* shown in FIG. 3 so as to measure the vertex of the surface layer 2*c* while the development roller 2 was being fixed. Such measurements of the surface roughness had measurement conditions that were a cutoff λc of 0.8 mm, a measurement length of 2.5 mm and a feed speed of 0.1 mm according to a roughness curve measuring method defined by JISB0601-1994. In addition, the contact pin had a tip of 2 μmR and a contact pin pressure of 0.07 gf, and each of the circumference direction measurement and the axial direction measurement measured the surface roughness in three locations in the axial direction (indicated by the arrow 2*e* shown in FIG. 3) and calculated an average value. Here, the ten-point mean roughness obtained by the circumference direction measurement is represented as Rz1, and the mean width of profile elements thereof is represented as Sm1 while the ten-point mean roughness obtained by the axial direction measurement is represented as Rz2, and the mean width of profile elements thereof is represented as Sm2.

For the metal core 2*a* of the development roller 2 of the first embodiment, a metal core 2*a* formed by a metal shaft having an outside diameter of 10.00 mm and made of SUM23L grade steel (JIS steel grade for a free cutting steel material) was plated with the electroless nickel. For the elastic layer 2*b* having the electric conductivity, a base material having the silicone rubber as the principal component was used and applied with a grinding process using a drum sanding machine after being ground roughly, so that the roughness was formed on the surface layer 2*c*. For the surface layer 2*c*, the amino silane as a surface active agent was coated after a surface hardening process by UV irradiation was performed. Eventually, the development roller 2 had the outside diameter of 17.62 mm and a hardness of the surface layer 2*c* had 42 degrees measured by a micro-durometer MD-1 type A (available from Kobunshi Keiki CO., LTD, Japan).

Here, development roller samples A-1 to A-8, B1 to B-12 and D-1 to D-24 applied with different film abrasion processes including film roughness, film abrasion pressure, a film abrasion speed, a film feed speed, a number of film abrasion and a sample rotation speed were prepared, and the surface roughness of each of the surface layer 2*c* of the samples was measured. The results are shown in TABLE 1. For example, a surface of the sample B-1 was applied with the abrasion process with the film abrasion pressure of 1.0 kg, the film abrasion speed of 1300 mm/min, the film feed speed of 10 mm/min, the number of film abrasion of one (1), and the sample rotation speed of 2000 rpm using sandpaper having a width of 100 mm and an abrasive grain of 40 μm in such a manner to provide values of Rz1, Sm1, Rz2 and Sm2 listed in TABLE 1.

The values of Rz1, Sm1, Rz2 and Sm2 can be adjusted by following methods. The value of Rz1 can be adjusted by roughness of the sandpaper or the film abrasion pressure. For example, the abrasive grain of the sandpaper is roughened, or the film abrasion pressure is increased, thereby increasing the value of Rz1. The value of Rz2 can be adjusted by the roughness of the sandpaper or the film abrasion speed. For example, the abrasive grain of the sandpaper is roughened, or the film abrasion speed is decreased, thereby increasing the value of Rz2. The value of Sm1 can be adjusted by the film feed speed or the sample rotation speed. For example, the film feed speed is increased, or the sample rotation speed is increased, thereby increasing the value of Sm1. The value of Sm2 can be adjusted by the film abrasion speed or the number of film abrasion. For example, the film abrasion speed is decreased, or the number of film abrasion is increased, thereby increasing the value of Sm2. Each of such conditions interacts one another. Therefore, the samples had desirable values of Rz1, Sm1, Rz2 and Sm2 by combination of the above conditions.

Figure 4:
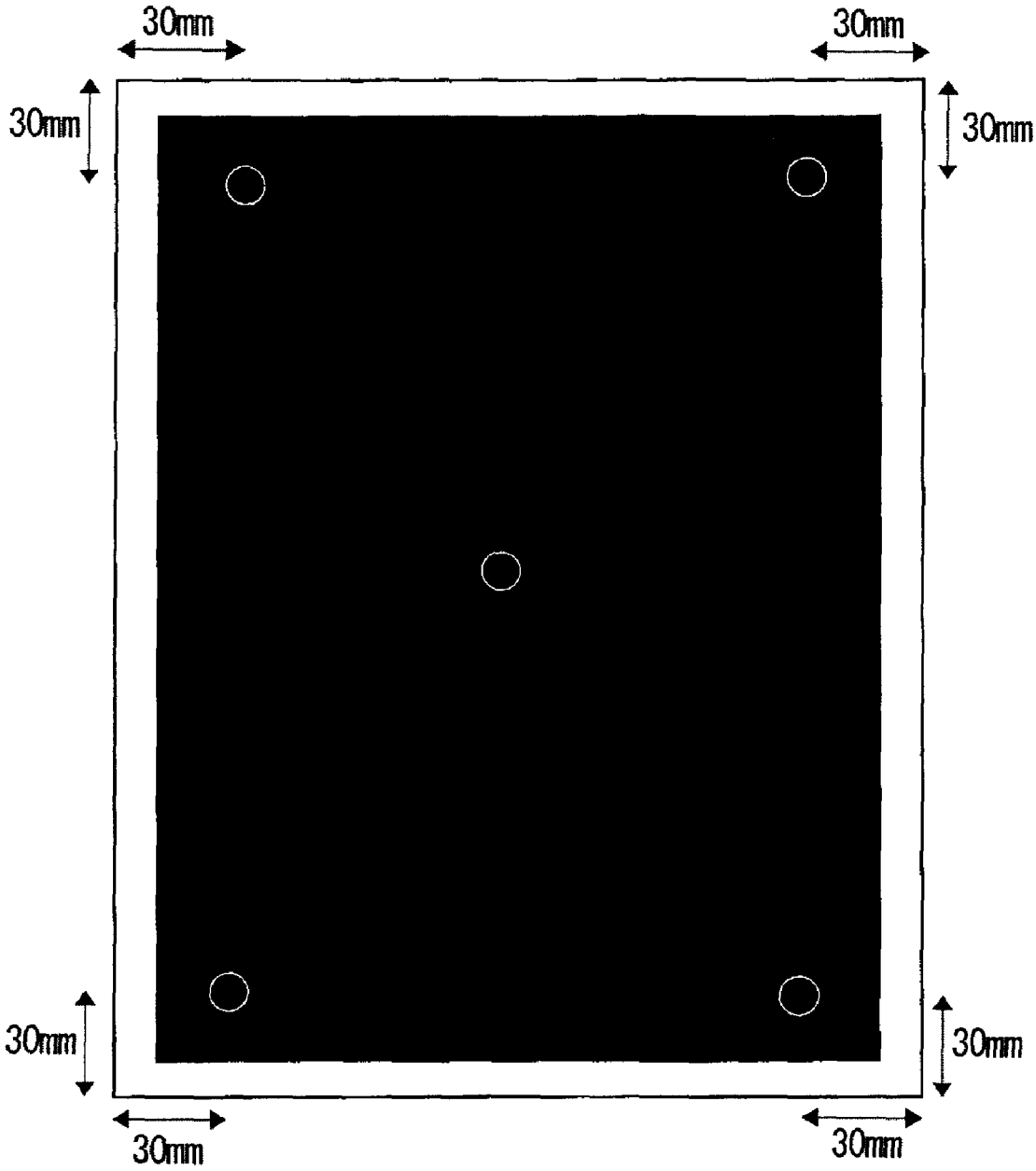
FIG. 4 is a schematic diagram illustrating a method for measuring a print density.

In the first example experiment, each of the samples was evaluated based on print density. Where an area of a solid image across the entire printable region of a sheet as illustrated in FIG. 4 was defined as an image density of 100 percent, a black image having such an image density of 100 percent (i.e., a solid black print pattern was formed across the entire printable region of the sheet) was formed using each of the above described samples as a development roller of an image forming apparatus, and print densities of predetermined locations in a print region were measured so as to calculate an average value as the print density. As illustrated in FIG. 4, the measurement locations of the print densities were indicated by four white circles each of which was shifted by 30 mm in vertical and horizontal directions of the sheet toward inside from respective apex angle and one white circle disposed substantially at the middle of the sheet, thereby a total of five measurement locations. The image forming apparatus used for such measurement was a monochrome printer and performed a printing operation in conditions of a circumference speed of a photosensitive drum of 103.13 rpm, a circumference speed ratio of the development roller with respect to the photosensitive drum of 1.239, a print speed of 22 PPM, an ambient temperature of 25 degrees centigrade and an ambient humidity of 50 percent. A value of the print density was measured by an X-Rite Spectrodensitometer. Such a value of the print density is shown in TABLE 1 as well as the values of Rz1, Sm1, Rz2 and Sm2. Descriptions of a density difference ΔY and fog evaluation shown in TABLE 1 will be given later with a description of a second example experiment.

TABLE 1

| SAMPLE | Rz1 [μm] | Sm1 [μm] | Rz2 [μm] | Sm2 [μm] | Rz2/Rz1 | Sm2/Sm1 | DENSITY | ΔY | FOG EVALUATION |
|---|---|---|---|---|---|---|---|---|---|
| A-1 | 7.00 | 45.00 | 7.20 | 50.00 | 1.03 | 1.11 | 1.18 | 1.78 | ○ |
| A-2 | 7.50 | 35.00 | 7.39 | 44.00 | 0.99 | 1.26 | 1.19 | 1.33 | ○ |
| A-3 | 7.25 | 40.00 | 8.26 | 42.00 | 1.14 | 1.05 | 1.14 | 0.78 | ○ |
| A-4 | 7.70 | 46.00 | 6.10 | 74.00 | 0.79 | 1.61 | 1.05 | 0.20 | ○ |
| A-5 | 8.21 | 45.00 | 7.35 | 48.00 | 0.90 | 1.07 | 1.15 | 0.85 | ○ |
| A-6 | 8.63 | 37.00 | 8.89 | 46.00 | 1.03 | 1.24 | 1.11 | 0.99 | ○ |
| A-7 | 7.85 | 52.00 | 6.98 | 62.00 | 0.89 | 1.19 | 1.12 | 1.12 | ○ |
| A-8 | 9.24 | 37.00 | 8.05 | 48.00 | 0.87 | 1.30 | 1.14 | 1.05 | ○ |
| B-1 | 9.44 | 151.00 | 12.17 | 82.00 | 1.29 | 0.54 | 1.32 | 2.78 | ○ |
| B-2 | 8.56 | 150.00 | 11.18 | 113.00 | 1.31 | 0.75 | 1.30 | 2.88 | ○ |
| B-3 | 9.39 | 119.00 | 11.50 | 92.00 | 1.22 | 0.77 | 1.28 | 2.77 | ○ |
| B-4 | 11.57 | 172.00 | 13.72 | 113.00 | 1.19 | 0.66 | 1.24 | 2.11 | ○ |
| B-5 | 10.38 | 139.00 | 11.27 | 76.00 | 1.09 | 0.55 | 1.23 | 2.33 | ○ |
| B-6 | 10.88 | 142.00 | 13.12 | 92.00 | 1.21 | 0.65 | 1.26 | 2.37 | ○ |
| B-7 | 10.47 | 148.00 | 12.23 | 91.00 | 1.17 | 0.61 | 1.29 | 2.92 | ○ |
| B-8 | 9.43 | 114.00 | 11.36 | 82.00 | 1.20 | 0.72 | 1.29 | 2.89 | ○ |
| B-9 | 9.29 | 140.00 | 12.59 | 75.00 | 1.35 | 0.54 | 1.31 | 2.93 | ○ |
| B-10 | 7.82 | 121.00 | 10.44 | 92.00 | 1.34 | 0.76 | 1.30 | 2.95 | ○ |
| B-11 | 6.58 | 137.00 | 9.14 | 82.00 | 1.39 | 0.60 | 1.31 | 2.97 | ○ |
| B-12 | 8.35 | 153.00 | 12.45 | 90.00 | 1.49 | 0.59 | 1.35 | 3.67 | Δ |
| BOUNDARY A | 7.95 | 54.00 | 7.95 | 54.00 | 1.00 | 1.00 | 1.20 | 1.89 | ○ |

TABLE 1-continued

| SAMPLE | Rz1 [μm] | Sm1 [μm] | Rz2 [μm] | Sm2 [μm] | Rz2/Rz1 | Sm2/Sm1 | DENSITY | ΔY | FOG EVALUATION |
|---|---|---|---|---|---|---|---|---|---|
| BOUNDARY B | 6.89 | 38.00 | 6.89 | 8.00 | 1.00 | 0.21 | 1.22 | 2.28 | ○ |
| BOUNDARY C | 8.95 | 87.00 | 14.32 | 18.00 | 1.60 | 0.21 | 1.40 | 4.99 | Δ |
| BOUNDARY D | 8.99 | 125.00 | 14.38 | 125.00 | 1.60 | 1.00 | 1.39 | 5.00 | Δ |
| BOUNDARY E | 7.56 | 65.00 | 10.55 | 65.00 | 1.40 | 1.00 | 1.25 | 2.80 | ○ |
| BOUNDARY F | 10.52 | 135.00 | 14.75 | 54.00 | 1.40 | 0.40 | 1.30 | 2.98 | ○ |
| BOUNDARY G | 9.33 | 114.00 | 9.33 | 46.00 | 1.00 | 0.40 | 1.22 | 2.30 | ○ |
| D-1 | 14.30 | 161.00 | 23.50 | 31.00 | 1.64 | 0.19 | 1.53 | 6.20 | X |
| D-2 | 12.10 | 134.00 | 19.77 | 142.00 | 1.63 | 1.06 | 1.45 | 5.55 | X |
| D-3 | 6.40 | 79.00 | 6.25 | 19.00 | 0.98 | 0.24 | 1.19 | 1.89 | ○ |
| D-4 | 7.25 | 112.00 | 7.61 | 89.60 | 1.05 | 0.80 | 1.21 | 2.00 | ○ |
| D-5 | 11.34 | 159.00 | 15.65 | 143.10 | 1.38 | 0.90 | 1.27 | 2.87 | ○ |
| D-6 | 12.01 | 147.00 | 15.97 | 47.04 | 1.33 | 0.32 | 1.30 | 3.00 | ○ |
| D-7 | 8.56 | 160.00 | 8.73 | 54.40 | 1.02 | 0.34 | 1.22 | 2.50 | ○ |
| D-8 | 9.43 | 177.00 | 12.35 | 35.40 | 1.31 | 0.20 | 1.31 | 3.00 | ○ |
| D-9 | 11.39 | 132.00 | 17.31 | 30.36 | 1.52 | 0.23 | 1.38 | 4.44 | Δ |
| D-10 | 9.32 | 148.00 | 13.42 | 62.16 | 1.44 | 0.42 | 1.33 | 2.99 | ○ |
| D-11 | 10.44 | 128.00 | 16.50 | 119.04 | 1.58 | 0.93 | 1.33 | 3.00 | Δ |
| D-12 | 8.43 | 134.00 | 9.95 | 117.92 | 1.18 | 0.88 | 1.23 | 2.33 | ○ |
| D-13 | 7.77 | 133.00 | 8.94 | 29.26 | 1.15 | 0.22 | 1.25 | 2.80 | ○ |
| D-14 | 7.80 | 132.00 | 7.18 | 106.92 | 0.92 | 0.81 | 1.18 | 2.00 | ○ |
| D-15 | 8.20 | 145.00 | 7.71 | 62.35 | 0.94 | 0.43 | 1.19 | 2.00 | ○ |
| D-16 | 8.88 | 162.00 | 8.61 | 22.68 | 0.97 | 0.14 | 1.17 | 1.88 | ○ |
| D-17 | 9.25 | 188.00 | 11.38 | 15.04 | 1.23 | 0.08 | 1.41 | 4.30 | Δ |
| D-18 | 10.40 | 169.00 | 15.29 | 25.35 | 1.47 | 0.15 | 1.41 | 4.66 | Δ |
| D-19 | 15.20 | 171.00 | 25.99 | 8.55 | 1.71 | 0.05 | 1.52 | 5.80 | X |
| D-20 | 15.58 | 170.00 | 26.17 | 88.40 | 1.68 | 0.52 | 1.44 | 5.00 | X |
| D-21 | 24.69 | 154.00 | 45.18 | 149.38 | 1.83 | 0.97 | 1.58 | 6.70 | X |
| D-22 | 12.48 | 98.00 | 19.72 | 111.72 | 1.58 | 1.14 | 1.18 | 1.40 | ○ |
| D-23 | 10.40 | 78.00 | 14.56 | 95.16 | 1.40 | 1.22 | 1.19 | 1.80 | ○ |
| D-24 | 9.64 | 54.00 | 12.05 | 62.10 | 1.25 | 1.15 | 1.19 | 1.50 | ○ |

According to the results shown in TABLE 1, although the development rollers have similar values of the ten-point mean roughness Rz1 in the circumference direction, the print densities vary. A comparison between the samples A-8 and B-9, for example, the sample A-8 has the value of the ten-point mean roughness Rz1 in the circumference direction of 9.24 μm, and the sample B-9 has that of 9.29 μm. In other words, the samples A-8 and B-9 have substantially the same values of the ten-point mean roughness Rz1 in the circumference direction. However, the sample A-8 has the print density of 1.14 while the sample B-9 has the print density of 1.31. Thus, the differences in the print densities are recognized. Since each of the samples A-8 and B-9 has a different surface state of the surface layer 2*c* of the development roller 2, a difference of an absolute value of an adhesion amount of the toner 8 for development simply provides a difference of the print density.

According to the first example experiment, the surface roughness was not only measured in the circumference direction but also in the axial direction of the development roller 2 so that the surface state of the surface layer 2*c* of the development roller was more accurately converted into a numerical term. As shown in TABLE 1, the roughness of the surface layer 2*c* of each sample is expressed by an index value of Rz2/Rz1, and the roughness density of the surface layer 2*c* of each sample is expressed by an index value of Sm2/Sm1.

Figure 5:
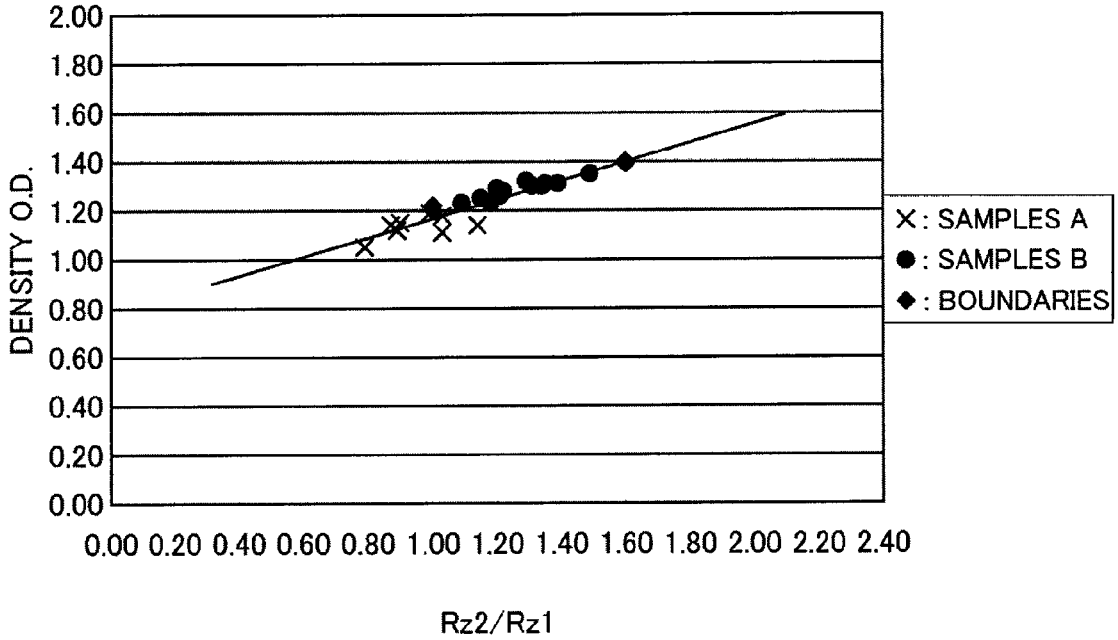
FIG. 5 is a correlation diagram illustrating roughness Rz2/Rz1 of a surface layer of the development roller and a print density.

Referring to FIG. 5, a correlation between the value of Rz2/Rz1 and the print density of each of the samples is illustrated. As illustrated in FIG. 5, the value of Rz2/Rz1 and the print density have the correlation. Based on such a correlation, the value of Rz2/Rx1 for providing a good print density is considered. In general, the good print density is ranged between 1.20 and 1.40. Where the print density is below 1.20, the adequate print density is not obtained. On the other hand, where the print density is above 1.40, excess toner is developed on the sheet due to dense of the print density, causing soiling of the sheet. When an appropriate value of Rz2/Rz1 is calculated from an approximation line of FIG. 5 based on the good print density, the value of Rz2/Rz1 corresponding to the lower limit value 1.20 of the print density is 1.00, and the value Rz2/Rz1 corresponding to the upper limit value 1.40 of the print density is 1.60. In other words, where the value of Rz2/Rz1 satisfies a range between greater than or equal to 1.00 and smaller than or equal to 1.60 ($1.00 \leqq Rz2/Rz1 \leqq 1.60$) in the surface layer 2*c* of the development roller 2, the print density is believed to be satisfied. However, although the condition of $1.00 \leqq Rz2/Rz1 \leqq 1.60$ was satisfied, the sample having the print density of below 1.20 was recognized.

Figure 6:
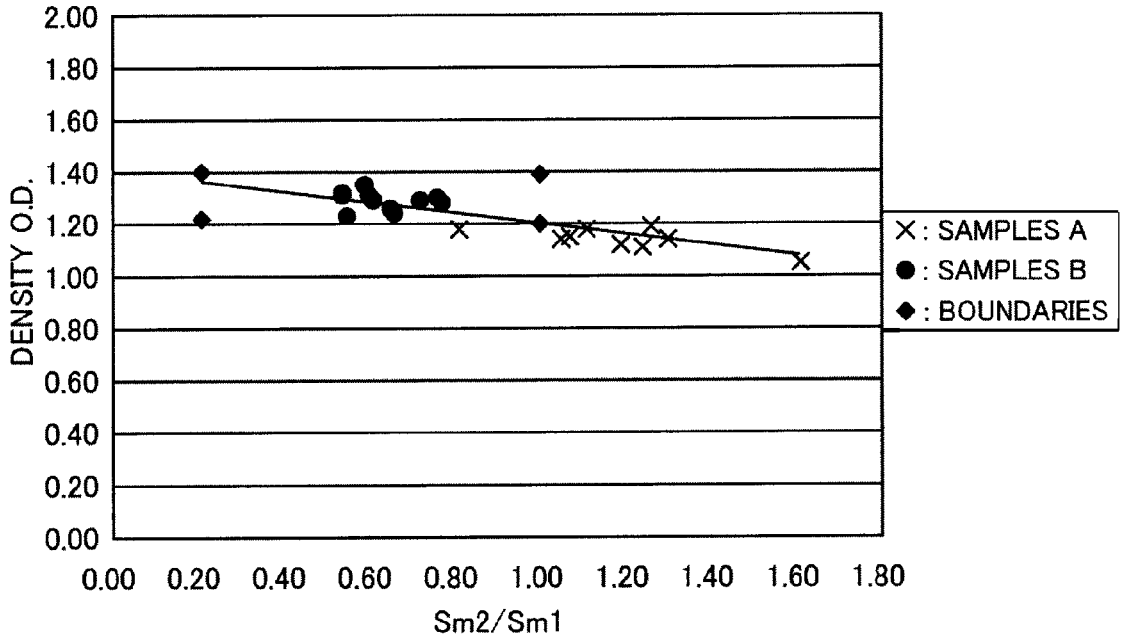
FIG. 6 is another correlation diagram illustrating a roughness density Sm2/Sm1 of the surface layer of the development roller and the print density.

Referring to FIG. 6, a correlation between the value of Sm2/Sm1 and the print density of each of the samples is illustrated. Similar to FIG. 5, the value of Sm2/Sm1 and the print density have the correlation. Based on such a correlation, the value of Sm2/Sm1 for providing the good print density is considered. Since the good print density is generally ranged between 1.20 and 1.40, the value of Sm2/Sm1 corresponding to the lower limit value 1.20 of the print density is 1.00, and the value of Sm2/Sm1 corresponding to the upper limit value 1.40 of the print density is 0.20 when the suitable value of Sm2/Sm1 is calculated from an approximation line of FIG. 6. In other words, where the value of Sm2/Sm1 satisfies a range between greater than or equal to 0.20 and smaller than or equal to 1.00 ($0.20 \leqq Sm2/Sm1 \leqq 1.00$) in the surface layer 2*c* of the development roller 2, the print density is believed to be satisfied. However, although the condition of $0.20 \leqq Sm2/Sm1 \leqq 1.00$ was satisfied, the sample having the print density of below 1.20 was recognized.

Therefore, the surface state of the surface layer 2*c* cannot be adequately expressed by at least one of the values of the roughness Rz2/Rz1 of the surface layer 2*c* and the roughness density Sm2/Sm1 of the surface layer 2*c*. However, since the sample having the values satisfying both the roughness Rz1/Rz1 of the surface layer 2*c* and the roughness density of Sm2/Sm1 obtains the adequate print density, the surface state of the surface layer 2*c* is appropriately expressed by both the roughness Rz2/Rz1 of the surface layer 2*c* and the roughness density Sm2/Sm1 of the surface layer 2*c*.

Figure 7:
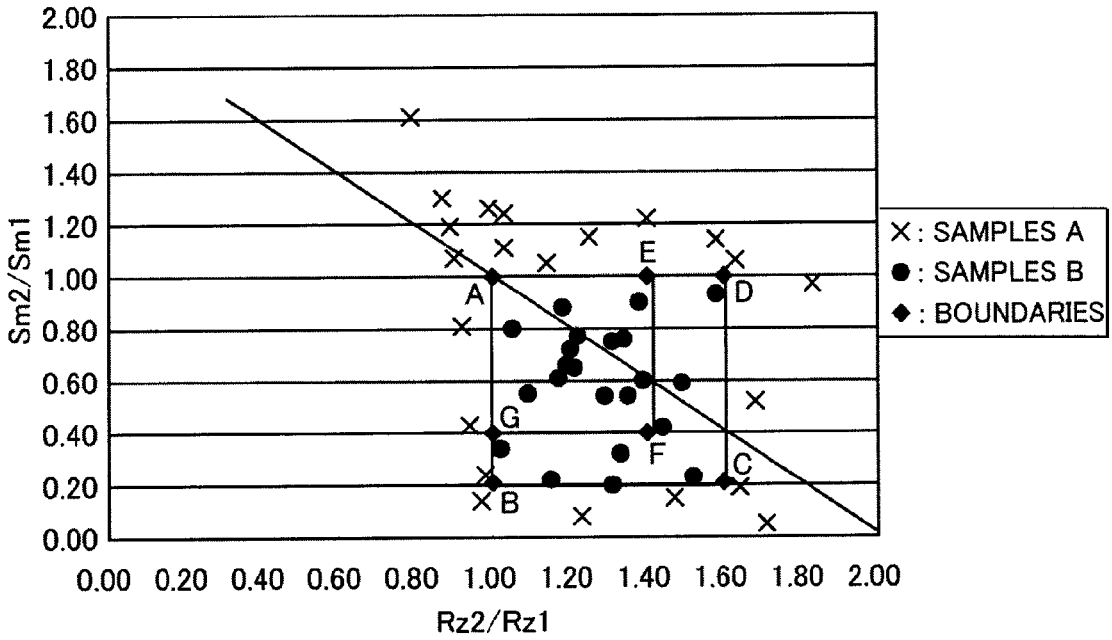
FIG. 7 is yet another correlation diagram illustrating the roughness Rz2/Rz1 and the roughness density Sm2/Sm1 of the surface layer of the development roller.

Referring to FIG. 7, a correlation between the roughness Rz2/Rz1 of the surface layer 2*c* and the roughness density Sm2/Sm1 of the surface layer is illustrated. In FIG. 7, points A through G respectively correspond to boundaries A through G listed in TABLE 1. Where a boundary line connecting points A and B is provided, that is, the value of the roughness Rz2/Rz1 of the surface layer 2*c* is smaller than 1.00, the absolute value of the roughness of the surface layer 2*c* is relatively small, and a stipulated print density is not satisfied. Where a boundary line connecting points C and D is provided, that is, the value of the roughness Rz2/Rz1 of the surface layer 2*c* is greater than 1.60, the absolute value of the roughness of the surface layer 2*c* becomes excessive, causing soiling of the sheet by excess adhesion of the toner. Where a boundary line connecting the points B and C is provided, that is, the value of the roughness density Sm2/Sm1 of the surface layer 2*c* is smaller than 0.20, the density of the roughness of the surface layer 2*c* is excessively high, causing a possibility of soiling the sheet by excess adhesion of the toner. Where a boundary line connecting the points A and D is provided, that is, the value of the roughness density Sm2/Sm1 of the surface layer 2*c* is greater than 1.00, the density of the roughness of the surface layer 2*c* is low, and the toner is not adequately carried, causing not satisfying the stipulated print density. Therefore, a region surrounded by the boundary lines connecting the points A, B, C and D becomes conditions that satisfy the print density. In other words, where the value of the roughness Rz1/Rz1 of the surface layer 2*c* of the development roller 2 satisfies the range between 1.00 and 1.60 ($1.00 \leqq Rz2/Rz1 \leqq 1.60$) (formula 1) and the value of the roughness density Sm2/Sm1 of the surface layer 2*c* satisfies the range between 0.20 and 1.00 ($0.20 \leqq Sm2/Sm1 \leqq 1.00$) (formula 2), the development roller 2 forms the image with the good print density.

Figure 8:
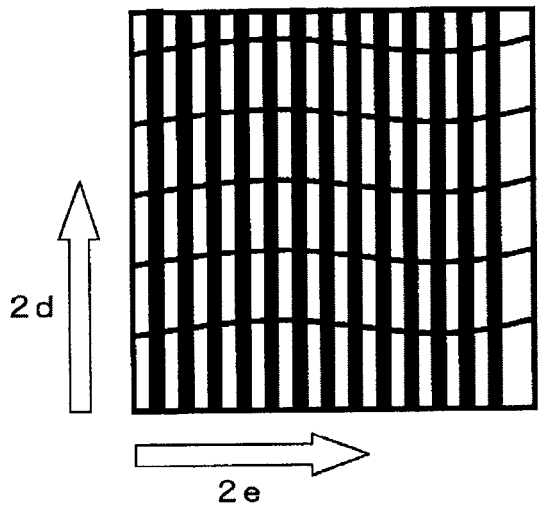
FIG. 8 is a model diagram illustrating a surface state of the surface layer of the development roller where the roughness Rz2/Rz1 satisfies a formula 1 and the roughness density Sm2/Sm1 satisfies a formula 2.
Figure 9:
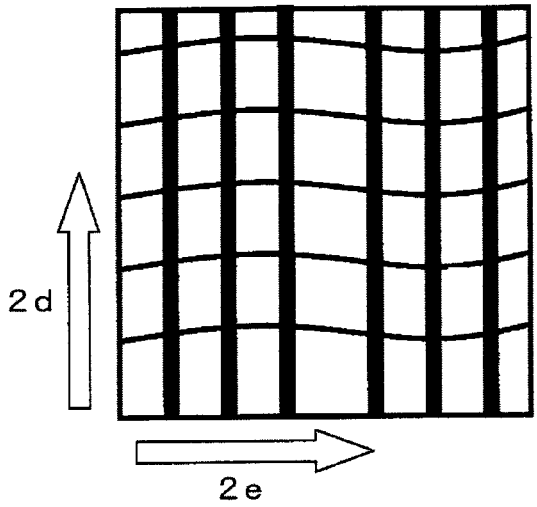
FIG. 9 is another model diagram illustrating a state of the surface layer of the development roller where the roughness Rz2/Rz1 satisfies the formula 1 and the roughness density Sm2/Sm1 does not satisfy the formula 2.
Figure 10:
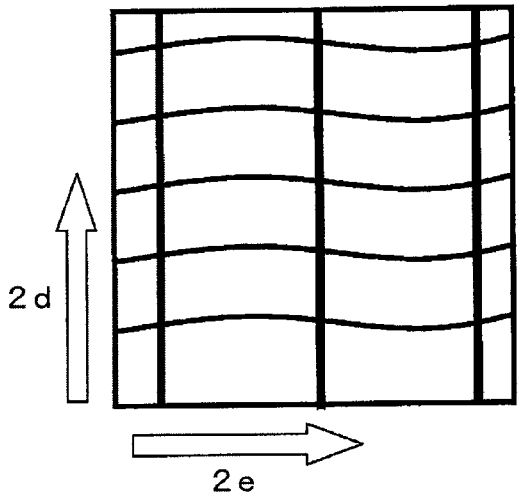
FIG. 10 is yet another model diagram illustrating a state of the surface layer of the development roller where the roughness Rz2/Rz1 does not satisfy the formula 1 and the roughness density Sm2/Sm1 does not satisfy the formula 2.

Referring to FIGS. 8 to 10, the surface sates of the surface layer 2*c* indicated by each value of the formulas 1 and 2 stated above are illustrated in model diagrams. In each of FIGS. 8 to 10, each of vertical lines extending in the circumference direction (i.e., indicated by the arrow 2*d*) represents a groove prepared by the film abrasion process, and each of wavy lines extending in the axial direction (i.e., indicated by the arrow 2*e*) represents an abrasion mark generated by a finishing abrasion process and the film abrasion process. The value of Rz2/Rz1 represents a relationship of the roughness between the groove and the abrasion mark, and the greater the value of Rz2/Rz1, the greater the roughness of the groove than that of the abrasion mark. In other words, the value of Rz2/Rz1 can be used to determine whether or not the film abrasion process is appropriately provided to the surface layer 2*c* with predetermined pressure. The value of Sm2/Sm1 represents a relationship of the roughness density between the groove and the abrasion mark, and the smaller the value of Sm2/Sm1, the smaller the pitch of the grooves than that of the abrasion marks, thereby having the grooves densely. In other words, the value of Sm2/Sm1 can be used to determine whether or not the film abrasion process is appropriately provided to the surface layer 2*c* with predetermined speed.

A model illustrated in FIG. 8 is a case where the value of the roughness Rz2/Rz1 of the surface layer 2*c* is 1.55, and the value of the roughness density Sm2/Sm1 of the surface layer 2*c* is 0.42. The value of the roughness Rz2/Rz1 of the surface layer 2*c* satisfies the formula 1 above, and the value of the roughness density Sm2/Sm1 of the surface layer 2*c* satisfies the formula 2 above. Therefore, the good print density of 1.37 is provided.

A model illustrated in FIG. 9 is a case where the value of the roughness Rz2/Rz1 of the surface layer 2*c* is 1.05, and the value of the roughness density Sm2/Sm1 of the surface layer 2*c* is 1.05. The value of the roughness Rz2/Rz1 of the surface layer 2*c* satisfies the formula 1 above; however, the value of the roughness density Sm2/Sm1 of the surface layer 2*c* does not satisfy the formula 2 above. In such a case, the density of the grooves of the surface layer 2*c* is low as illustrated in FIG. 9. Consequently, the print density becomes a non-stipulated value of 1.18.

A model illustrated in FIG. 10 is a case where the value of the roughness Rz2/Rz1 of the surface layer 2*c* is 0.91, and the value of the roughness density Sm2/Sm1 of the surface layer 2*c* is 1.30. The value of the roughness Rz2/Rz1 of the surface layer 2*c* does not satisfy the formula 1 above, and the value of the roughness density Sm2/Sm1 of the surface layer 2*c* does not satisfy the formula 2 above. In such a case, the roughness of the surface layer 2*c* and the density of the grooves of the surface layer 2*c* are low as illustrated in FIG. 10. Consequently, the print density becomes a non-stipulated value of 1.15.

Therefore, where the development roller 2 satisfies the ranges of the formulas 1 and 2 described above, not only the development device 10 including the development roller 2 therein can develop the image with the good print density, but also the image forming apparatus 100 including the development device 10 therein can print the image with the good print density on the sheet. Moreover, the value of the roughness Rz2/Rz1 and the value of the roughness density Sm2/Sm1 of the surface layer 2*c* of the development roller 2 can be used as control items in a course of manufacturing the development roller 2.

SECOND EXAMPLE EXPERIMENT

Figure 11:
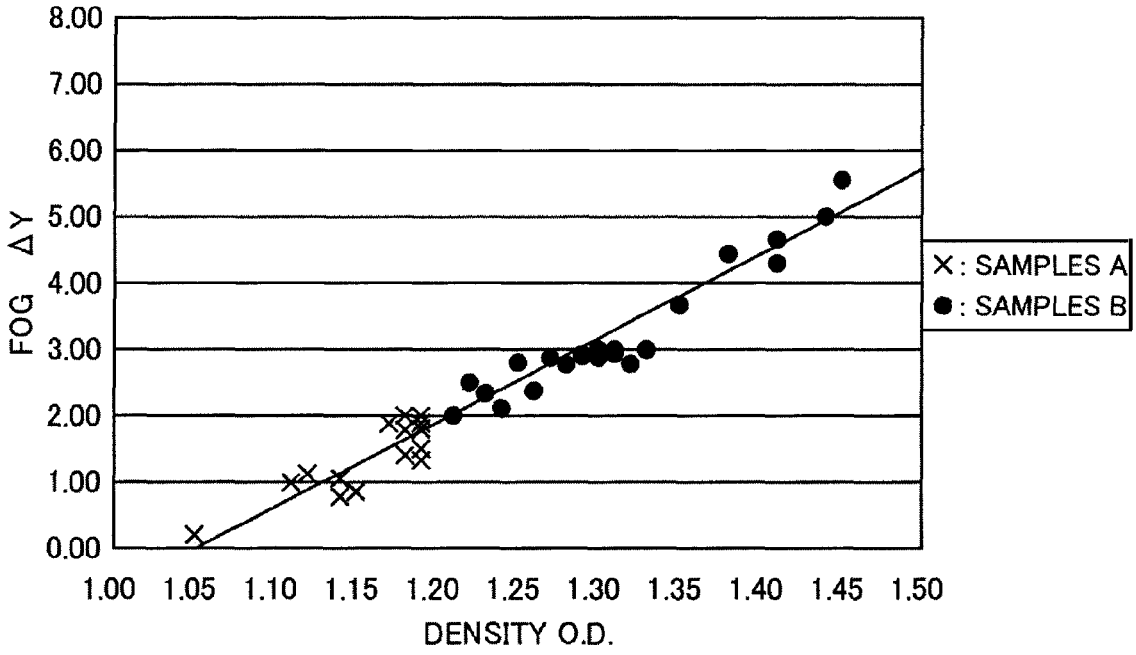
FIG. 11 is a correlation diagram illustrating the print density and a density difference evaluating fog.

According to the first example experiment described above, where the formulas 1 and 2 are satisfied, the good print density is obtained. However, there raises a problem that the fog slightly deteriorates in the vicinity of the boundary C in the FIG. 7. In other words, the fog tends to be occurred with an increase in the print density. Such an increase in the print density causes an increase in a thickness of the toner layer to be formed on the surface layer 2*c* of the development roller 2. Since the toner layer is formed on the surface layer 2*c* of the development roller 2 not only by electric force generated by a bias difference or frictional charge between the development roller 2 and the supply roller 3, but also by mechanical force generated by the roughness of the surface layer 2*c* of the development roller 2 or conveyance force of the supply roller 3, the surface layer 2*c* of the development roller 2 includes toner being in a poorly charged state. That is, the increase in the thickness of the toner layer causes an increase in an amount of the toner being in the poorly charged state, resulting in an increase in an amount of fog toner. A correlation between the density difference ΔY (described later) and the print density is illustrated in FIG. 11 using an index value regarding the fog in each of the samples listed in TABLE 1. When the print density increases, a level of the fog deteriorates as illustrated in FIG. 11.

Particularly, where a glossy sheet of paper having a gloss level of at least 58 (measured by a Gloss Meter Type GM-26D available from Murakami Color Research Laboratory, Japan, with a viewing angle of 75 degrees) is used, the toner of drum fog becomes noticeable on the glossy sheet due to a greater smoothness of a surface of the sheet with an increase in the gloss level, causing deterioration of the image as glossy sheet fog. In the second example experiment, a development roller capable of producing the image having reduced fog by reducing the drum fog to obtain a higher quality image is examined.

A description of the second example experiment is now given. A measurement of the fog was performed with respect to each of the samples of which density was evaluated in the first example experiment. In the fog measurement, the image forming apparatus was stopped in the middle of printing the density of zero percent, and the toner on the photosensitive drum 1 prior to the fixing process was adhered to an adhesive tape (Scotch mending tape available from Sumitomo 3M Ltd., Japan). Such an adhesive tape is referred to as a fog collection tape. The fog collection tape was attached onto a white sheet. Another adhesive tape (Scotch mending tape available from Sumitomo 3M Ltd., Japan) that was not adhered to the photosensitive drum 1 was also attached onto the white sheet as a comparison of the fog collection tape. Such an adhesive tape is referred to as a comparison tape.

A density difference between the fog collection tape and the comparison tape was measured by a spectrophotometer (a spectrophotometer CM-2600d available from Konica Minolta Holdings, Inc., with a measurement diameter of 8 mm), and the density difference ΔY was calculated by subtracting the density of the fog collection tape from the density of the comparison tape. The density difference ΔY calculated for each of the samples is listed in TABLE 1. In the evaluation of the fog toner, the sample having the density difference ΔY ranged between zero and three ($0 \leqq \Delta Y \leqq 3.00$) was evaluated as ○ (circle), the sample having the density difference ΔY ranged between three and five ($3.00 \leqq \Delta Y \leqq 5.00$) was evaluated as Δ (triangle), and the sample having the density difference ΔY over 5.00 ($5.00 \leqq \Delta Y$) was evaluated as X. Based on the results shown in the TABLE 1, the values of the print density corresponding to the values of the roughness Rx2/Rx1 and the roughness density Sm2/Sm1 of the surface layer 2*c* are summarized in TABLE 2. Moreover, based on the results shown in the TABLE 1, the evaluation of the fog corresponding to the values of the roughness Rx2/Rx1 and the roughness density Sm2/Sm1 of the surface layer 2*c* is summarized in TABLE 3.

TABLE 2

| | | Rz2/Rz1 | | | | | |
|---|---|---|---|---|---|---|---|
| | | 0.80 | 1.00 | 1.20 | 1.40 | 1.60 | 1.80 |
| Sm2/Sm1 | 0.10 | 1.19 | | | | 1.43 | 1.48 |
| | 0.20 | | 1.24 | 1.27 | 1.34 | 1.40 | 1.44 |
| | 0.40 | | 1.23 | 1.25 | 1.31 | 1.37 | |
| | 0.60 | 1.17 | 1.22 | 1.25 | 1.28 | 1.36 | |
| | 0.80 | | 1.20 | 1.23 | 1.27 | 1.34 | |
| | 1.00 | | 1.20 | 1.22 | 1.27 | 1.32 | |
| | 1.20 | 1.15 | 1.18 | | | | 1.40 |

TABLE 3

| | | Rz2/Rz1 | | | | | |
|---|---|---|---|---|---|---|---|
| | | 0.80 | 1.00 | 1.20 | 1.40 | 1.60 | 1.80 |
| Sm2/Sm1 | 0.10 | ○ | | | | X | X |
| | 0.20 | | ○ | ○ | Δ | Δ | X |
| | 0.40 | | ○ | ○ | ○ | Δ | |
| | 0.60 | ○ | ○ | ○ | ○ | Δ | |
| | 0.80 | | ○ | ○ | ○ | Δ | |
| | 1.00 | | ○ | ○ | ○ | Δ | |
| | 1.20 | ○ | ○ | | | | X |

According to the results shown in TABLE 2, the value of the roughness Rz2/Rz1 of the surface layer 2*c* ranged between and 6.00 and the value of the roughness density Sm2/Sm1 of the surface layer 2*c* ranged between 0.20 and 1.00 are relevant to the value of the good print density ranged between 1.20 and 1.40. In other words, where such conditions are satisfied, the good print density is obtained.

According to the results shown in TABLE 3, where the value of the roughness Rz2/Rz1 of the surface layer 2*c* is greater than 1.40, the fog is deteriorated. Where the value of the roughness density Sm2/Sm1 is smaller than 0.40, the fog is deteriorated. Therefore, a state of the surface layer 2*c* without occurrence of the fog has the value of the roughness Rz2/Rz1 of the surface layer 2*c* to be below 1.40 and the value of the roughness density Sm2/Sm1 to be above 0.40. The region surrounded by the boundary lines connecting the points A, E, F and G of FIG. 7 becomes the conditions for obtaining the good print density and reducing (if not eliminating) occurrences of the fog. In other words, where the value of the roughness Rz2/Rz1 of the surface layer 2*c* of the development roller 2 satisfies the range between 1.00 and 1.40 ($1.00 \leqq Rz2/Rz1 \leqq 1.40$) (Formula 3), and the value of the roughness density Sm2/Sm1 of the surface layer 2*c* satisfies the range between 0.40 and 1.00 ($0.40 \leqq Sm2/Sm1 \leqq 1.00$) (Formula 4), the development roller 2 forms the image with the good print density without occurrence of the fog.

Therefore, where the development roller 2 satisfies the ranges of the formulas 3 and 4 described above, not only the development device 10 including the development roller 2 therein can develop the image with the good print density without occurrence of the fog, but also the image forming apparatus 100 including the development device 10 therein can print the image with the good print density on the sheet without occurrence of the fog. Moreover, the value of the roughness Rz2/Rz1 and the value of the roughness density Sm2/Sm1 of the surface layer 2*c* of the development roller 2 can be used as control items in a course of manufacturing the development roller 2.

According to the embodiment of the present invention, the printer is described as the image forming apparatus 100, but the present invention is not limited thereto and can be applied to an image forming apparatus such as a multi-functional peripheral (MFP), a facsimile and a photocopier.

As can be appreciated by those skilled in the art, numerous additional modifications and variation of the present invention are possible in light of the above-described teachings. It is therefore to be understood that, within the scope of the appended claims, the disclosure of this patent specification may be practiced otherwise than as specifically described herein.

What is claimed is:

1. A development device comprising:

a developer carrier supplying developer to a rotatable electrostatic latent image carrier, the developer carrier comprising:

a conductive metal core; and a conductive elastic layer disposed outside a circumference of the conductive metal core and including a surface having a roughness formed thereon, the surface of the conductive elastic layer satisfying a relationship of $1.0 < Rz2/Rz1 < 1.60$, where Rz1 is a ten-point mean roughness in a circumference direction of the developer carrier and Rz2 is a ten-point mean roughness in an axial direction of the developer carrier, and satisfying a relationship of $0.20 < Sm2/Sm1 < 1.00$, where Sm1 is a mean width of profile elements of the surface of the conductive elastic layer in the circumference direction of the developer carrier, and Sm2 is a mean width of profile elements of the surface of the conductive elastic layer in the axial direction of the developer carrier, wherein a value of Rz1 is from 6.58 to 12.01 μm, wherein a value of Rz2 is from 6.89 to 17.31 μm, wherein a value of Sm1 is from 38.00 to 177.00 μm, and wherein a value of Sm2 is from 8.00 to 143.10 μm.

2. The development device according to claim 1, wherein the surface of the conductive elastic layer satisfies a relationship of $1.0<Rz2/Rz1<1.40$ and satisfies a relationship of $0.40<Sm2/Sm1<1.00$.

3. The development device according to claim 1, wherein the roughness is formed by cutting work.

4. An image forming apparatus comprising:

the development device according to claim 1;

an exposure device exposing a surface of the electrostatic latent image carrier and forming an electrostatic latent image based on image information;

a transfer unit transferring an developer image formed using the developer carrier by development of the electrostatic latent image formed on the surface of the electrostatic latent image carrier by the exposure device to a recording sheet; and a fixing unit fixing the developer image transferred by the transfer unit to the recording sheet.

5. The development device according to claim 1, wherein the surface of the conductive elastic layer is a surface layer formed on an outer circumference of the elastic layer, Rz1, Rz2, Sm1 and Sm2 representing surface states of the surface layer.

6. The development device according to claim 5, wherein the elastic layer has a volume resistivity of $10^5$ to $10^{11}$ Ω and a JIS-A hardness 20 to 60 degrees.

* * * * *